US007784241B1

(12) United States Patent
Patterson et al.

(10) Patent No.: US 7,784,241 B1
(45) Date of Patent: Aug. 31, 2010

(54) ARCHITECTURAL DETAILINGS

(76) Inventors: Richard M. Patterson, House Boat H, 2031 Fairview Ave. East, Seattle, WA (US) 98102; Michael W. LeBlanc, 34754 Pakenham Place, Mission, BC (CA) U2U 7A6

( * ) Notice: Subject to any disclaimer, the term of this patent is extended or adjusted under 35 U.S.C. 154(b) by 0 days.

(21) Appl. No.: 11/680,536

(22) Filed: Feb. 28, 2007

Related U.S. Application Data

(60) Continuation of application No. 11/624,628, filed on Jan. 18, 2007, and a division of application No. 10/921,761, filed on Aug. 18, 2004, now abandoned.

(60) Provisional application No. 60/495,978, filed on Aug. 18, 2003.

(51) Int. Cl.
*E04B 2/00* (2006.01)

(52) U.S. Cl. ..... 52/717.04; 52/287.1; 52/716.5; 52/98

(58) Field of Classification Search ..... 52/287.1, 52/288.1, 717.04, 716.1, 747.1, 747.11, 747.13, 52/745.2, 100, 98, 716.5
See application file for complete search history.

(56) References Cited

U.S. PATENT DOCUMENTS

| | | | | | |
|---|---|---|---|---|---|
| 2,299,908 | A * | 10/1942 | Leash | 52/406.1 |
| D135,578 | S * | 4/1943 | Marschner | D25/121 |
| 3,543,465 | A * | 12/1970 | Norman | 52/716.5 |
| 3,841,044 | A * | 10/1974 | Brown et al. | 52/717.05 |
| 3,998,014 | A * | 12/1976 | Bartels et al. | 52/100 |
| 4,183,987 | A * | 1/1980 | Eby et al. | 428/192 |
| 4,368,224 | A * | 1/1983 | Jackson | 428/31 |
| 5,193,322 | A | 3/1993 | Wood | |
| 5,463,835 | A | 11/1995 | Wood | |
| 5,508,103 | A | 4/1996 | Cope | |
| 5,616,396 | A * | 4/1997 | Ueki et al. | 428/139 |
| 5,662,753 | A | 9/1997 | Loos | |
| 6,228,507 | B1 * | 5/2001 | Hahn | 428/542.2 |
| 6,253,510 | B1 * | 7/2001 | Santarossa | 52/287.1 |
| RE37,436 | E | 11/2001 | Santarossa | |
| 2003/0014931 | A1 * | 1/2003 | Hahn | 52/287.1 |
| 2005/0175781 | A1 | 8/2005 | Schmidt | |
| 2006/0070323 | A1 | 4/2006 | Podirsky | |
| 2007/0175139 | A1 | 8/2007 | Nicolson | |

FOREIGN PATENT DOCUMENTS

| | | |
|---|---|---|
| CA | 2184205 | 3/1997 |

OTHER PUBLICATIONS

Office Action dated Jun. 24, 2009, from U.S. Appl. No. 11/624,628, filed Jan. 18, 2007, which is the parent of the present application.

* cited by examiner

*Primary Examiner*—Brian E Glessner
*Assistant Examiner*—Adriana Figueroa
(74) *Attorney, Agent, or Firm*—Christensen O'Connor Johnson Kindness PLLC

(57) ABSTRACT

An architectural detail (10 or 100) for coupling to a structure (124) to enhance the appearance of the structure. The architectural detail includes a core (18 or 118) and an outer covering (14 or 114) at least partially covering the core. The architectural detail further includes a support member (22 or 122) extending outward from the core. The support member is adapted to support the architectural detail a selected distance above a support surface (112) such that the outer covering disposed on the core of the architectural detail does not touch the support surface.

9 Claims, 3 Drawing Sheets

ARCHITECTURAL DETAILINGS

CROSS-REFERENCES TO RELATED APPLICATIONS

This application is a continuation of application Ser. No. 11/624,628, filed Jan. 18, 2007, and is a divisional of application Ser. No. 10/921,761, filed Aug. 18, 2004, which claims the benefit of Provisional Application No. 60/495,978, filed Aug. 18, 2003, all of the disclosures of which are incorporated by reference herein.

FIELD OF THE INVENTION

The present invention relates generally to architectural detailings and, more particularly, to architectural detailings adapted to permit more efficient application of surface coatings with fewer imperfections as well as to provide improved shipping and handling characteristics.

BACKGROUND

An architectural detail can transform a standard doorway into a grand archway and a fireplace mantle into a room's centerpiece. Finishing touches such as moldings and cornices are widely used in the homebuilding industry as a way to increase the aesthetic and economic value of a home. To obtain market share and to establish a reputation, builders are seeking out variations on classic architectural detailings.

In the recent past, architectural detailings were typically formed from stone/concrete or wood. With a number of advancements made within the foam industry, many builders are now utilizing pre-coated foam architectural detailings. One reason for their popularity is that they have a similar look and feel to precast, natural stone products, or wood, at the same time providing a significant reduction in raw material and installation costs. The foam based architectural detailings are also being used to accommodate climates adverse to wood and to offset rising wood costs.

In a typical construction, a mesh is applied to a foam core, then it is coated and topped with a stone like or other finish to create a product that is strong and aesthetically pleasing. The resulting product may be one-tenth the weight of precast stone. Further, the resultant product is easier and costs less money to install. It can be made in any shape and size. The manufacturing time is considerably less as well, and the cost is around 40 percent less for the installation of a foam product versus a precast product.

The foam base is easily formed into any shape, allowing designers wide latitude in designing the shape of the architectural detailings. The design aspects for coated foam products are infinite and have become extremely popular with architects and interior designers alike. The foam is dimensionally stable, resistant to expansion, contraction, warping, rotting and twisting. Additionally the foam is not a nutrient source for insects, which is important in humid and termite-prone climates.

Although previously developed faux architectural detailings are effective, they are not without their problems. It has been discovered that previously developed faux architectural detailings are not well adapted for properly drying the applied outer coating. More specifically, the foam core is coated with a selected liquid coating material or materials. Either before or after application of the liquid coating material, the architectural detail is placed upon a support structure, such as a drying rack to support the architectural detail during a drying process. However, as the liquid coating material cures into a solid, the coating material often adheres to the portions of the support structure contacting the coating material. When the architectural detail is lifted from the support structure, imperfections may be present in the outer coating of the architectural detail at the points where the architectural detail interfaces with the support structure. The imperfections reduce the quality, value, and appearance of the architectural detail and are therefore less desirable. Thus, there exists a need for an architectural detail having enhanced drying characteristics which aids in reducing the imperfections caused by coating and support structure interactions during the drying process, and that is reliable and inexpensive to manufacture.

SUMMARY

One embodiment of an architectural detail formed in accordance with the present invention for coupling to a structure to enhance the appearance of the structure is disclosed. The architectural detail includes a core and an outer covering at least partially covering the core. The architectural detail further includes a support member extending outward from the core. The support member is adapted to support the architectural detail a selected distance above a support surface such that the outer covering disposed on the core of the architectural detail does not touch the support surface.

Another embodiment of an architectural detail formed in accordance with the present invention for coupling to a structure to enhance the appearance of the structure is disclosed. The architectural detail includes a core formed from an extruded material, the core including at least a pair of support members integrally formed with the core and extending outward from the core along substantially an entire length of the core for supporting the core a selected distance above a support surface when the core is placed upon the support surface. The support members are selectively removable from the core. The architectural detail further includes a covering at least partially covering a portion of the core.

One method performed in accordance with the present invention of manufacturing and installing an architectural detail upon a structure to enhance the appearance of the structure is disclosed. The method includes extruding a core so as to have a support member extending outward from the core along a length of the core. The method further includes applying an outer covering to the core and placing the core upon a support surface such that the support member contacts the support surface to lift the core above the support surface a selected distance. The method further yet includes drying the outer covering upon the core.

DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION

Figure 1:
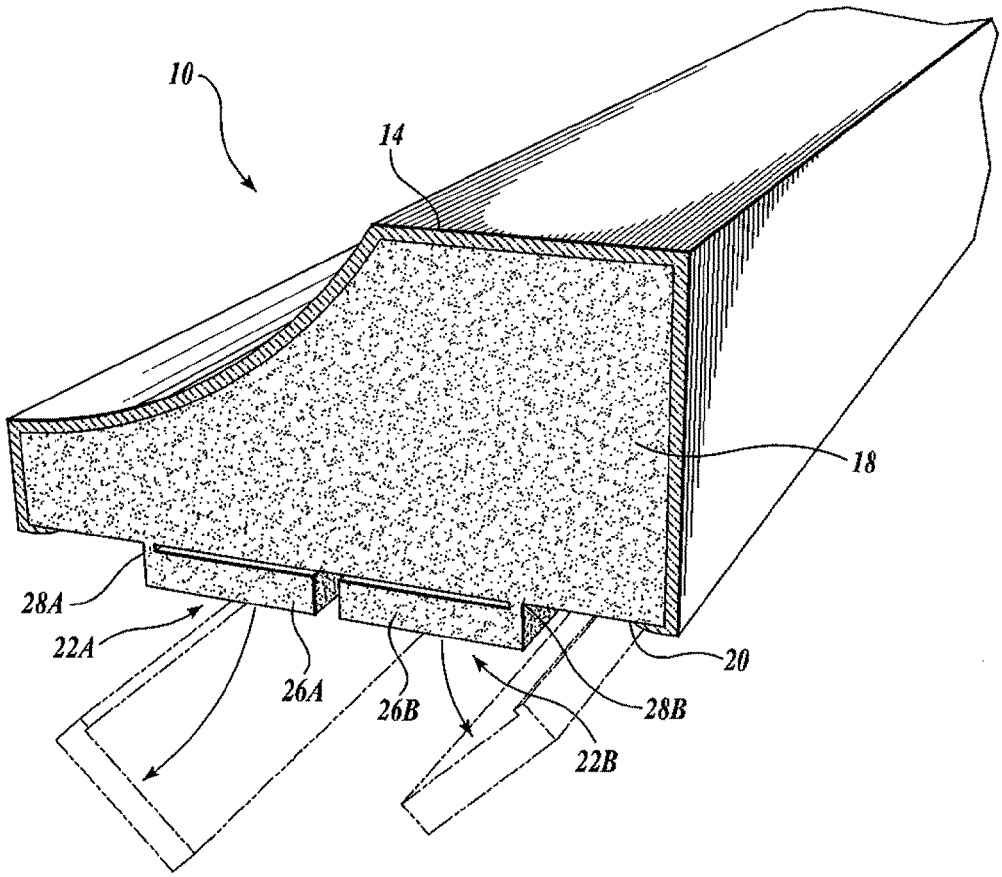
FIG. 1 is a perspective view of one embodiment of an architectural detail formed in accordance with the present invention, wherein the architectural detail is shown with a pair of support members for supporting the architectural detail above a support surface during a drying process, wherein the support members are selectively removable from the architectural detail by breaking the support members off as shown in phantom.

One embodiment of an architectural detail 10 formed in accordance with the present invention is depicted in FIG. 1. The architectural detail 10 may take many shapes/forms as is well known in the art. More specifically, architectural detailings formed in accordance with the present invention may take forms suitable for use in any application wherein a user wishes to enhance the appearance of a structure, a few examples being for use as sills, molding, window and door trim, banding, cornices, parapets, columns, caps, bases, keystones, quoins, etc.

Preferably, the architectural detail 10 includes a lightweight core 18, one suitable example being an extrudable material, such as Type I or Type II expanded polystyrene (EPS) foam. Preferably, the core 18 is coated with a coating material 14, suitable formed from a single material or a plurality of materials, such as a plurality of materials applied in a plurality of layers or a mixture of materials applied in a single layer as is well known in the art. The core 18 may be painted or factory finished with the coating material 14, such as an acrylic, in different textures and colors. Preferably, the coating 14 is pre-applied prior to installation, such as applied by the manufacturer. The coating 14 may be applied in a liquid form and then allowed to cure into a solid upon a support structure (not shown for clarity), such as a drying rack or table. The coating 14 provides a pleasing finish to the architectural detail 10, protects the lightweight core 18, repels moisture, etc.

The architectural detail 10 includes a pair of support members 22A and 22B oriented parallel to one another along the longitudinal length of the architectural detail 10. Preferably, the support members 22 are coupled to a substantially planar mounting surface 20 adapted to be mounted flush against a structure (not shown for clarity), a few suitable examples being a wall or ceiling of a building. Each support member 22 includes a base 26A and 26B. The bases 26 may be elongate block structures having a rectangular cross-section. The bases 26 may extend the entire longitudinal length of the architectural detail 10 or may be intermittently disposed along the longitudinal length of the architectural detail 10.

Each base 26 is coupled to the core 18 via a connector 28A and 28B. The connectors 28 may be elongate webs extending between the core 18 and the bases 26, coupling one to the other. The connectors 28 may extend the entire longitudinal length of the architectural detail 10 or may be intermittently disposed along the longitudinal length of the architectural detail 10. The connectors 28 permit the selective decoupling of the bases 26 from the core 18. Preferably, the connectors 28 present an area or line of reduced strength permitting a user to grasp and break off the support members 22 from the core 18 by moving the base 26 relative to the connector 28, such as by rotating the base 26 as shown in FIG. 1.

Preferably, the support members 22 are integrally formed with the core 18. In one embodiment, the core 18 and the support members 22 are simultaneously extruded from a well known extruder (not shown for clarity) so as to be integrally formed with one another, such that the core 18 and the support members 22 are a unitary, homogenous structure. Although the illustrated embodiment depicts the support members 22 as integrally formed with the core 18, it should be apparent to those skilled in the art that the support members 22 may be separate elements removably coupled to the core 18. Further still, although the illustrated embodiment depicts two support members 22 for supporting the architectural detail 10 upon a support surface, it should be apparent to those skilled in the art that other numbers of support members 22 are suitable for use with the present invention, such as one, or a number greater than two.

Further yet, although a specific geometric shape of the support members 22 are illustrated and described, it should be apparent to those skilled in the art that the support members 22 may take many suitable forms and/or geometric shapes, such as arcuate shapes or hybrid linear and arcuate shapes.

In light of the above description of the structure of the architectural detail 10, the operation of the architectural detail will now be described. During formation, a well known foam extruder (not shown) may be used to continuously extrude the core 18 from the extruder, including the integrally formed support members 22. The core 18 is then coated by well known techniques, preferably upon all but the bottom surface having the support members 22. The architectural detail 10 may be placed upon a support structure (not shown) such as drying rack, so that the coated surfaces are displaced above the support structure a selected distance by the support members 22. The outer coating 14 is then permitted to cure to at least the point where the architectural detail 10 may be handled without marring the coating 14. The support members 22 lift the core 18 a selected distance off of the support surface such that the coating 14 does not touch the support surface and therefore does not become marred by contact with the support surface.

At some point prior to installation, the support members 22 are broken off by rotating the base members 26 about the connectors 28. In one embodiment, the support members 22 are maintained intact during shipping and handling to aid in protecting the architectural detail 10 and are broken off just prior to installation. The broken off support members 22 may be discarded or recycled. The substantially planar mounting surface 20 is then placed against a structure (not shown), such as a wall or ceiling of a house, and fastened in place to enhance the aesthetic appearance of the structure.

Figure 2:
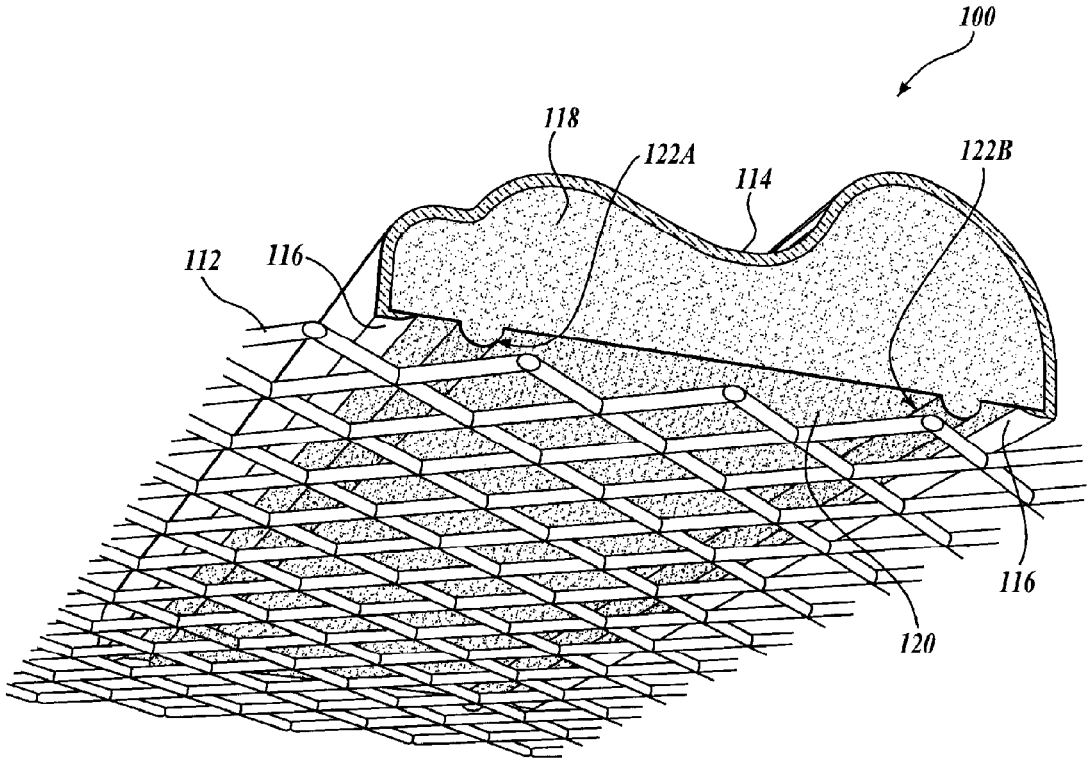
FIG. 2 is a perspective view of an alternate embodiment of an architectural detail formed in accordance with the present invention, wherein the architectural detail is shown with a pair of support members for supporting the architectural detail above a support surface during a drying process, wherein the support members are selectively removable from the architectural detail by abrasion.
Figure 3:
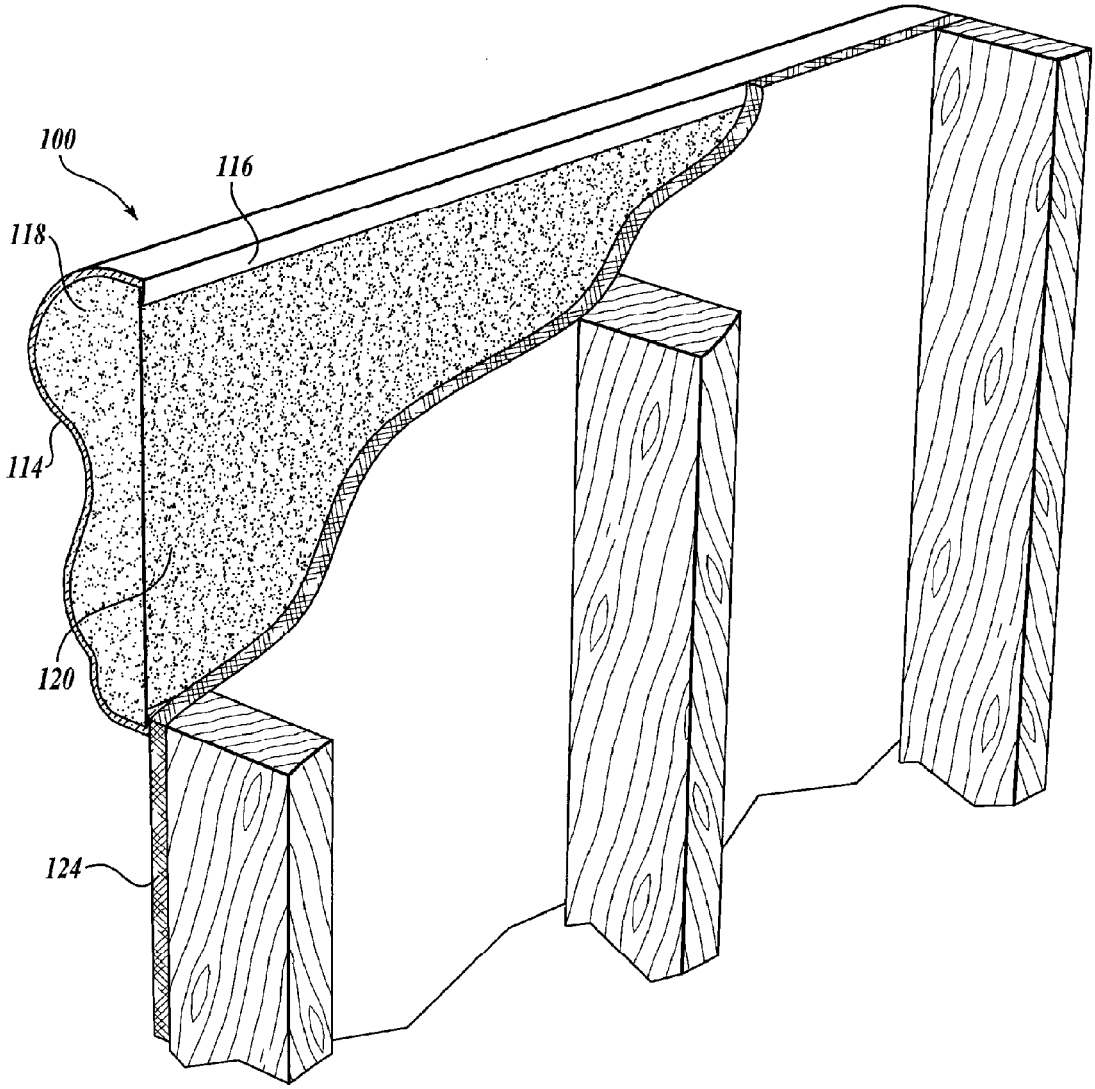
FIG. 3 is a perspective view of the architectural detail of FIG. 2 once the support members have been removed and the architectural detail coupled to a building structure.

Referring to FIGS. 2 and 3, an alternate embodiment of an architectural detail 100 formed in accordance with the present invention is shown. The alternate embodiment of FIGS. 2 and 3 is substantially similar to the embodiment described and depicted with reference to FIG. 1. Therefore, for the sake of brevity, this detailed description will focus only upon those aspects wherein the alternate embodiment of FIGS. 2 and 3 departs from the embodiment of FIG. 1.

Most notably, the architectural detail 100 differs from the above described architectural detail of FIG. 1 in the formation of a pair of support members 122. Moreover, the support members 122 of the architectural detail 100 of FIGS. 2 and 3 are adapted to be removed from the core 118 by abrasive forces, in contrast to the above described embodiment, wherein the support members 122 are adapted to be removed by being broken off.

Referring to FIGS. 2 and 3, the support members 122 are half round in cross-section and preferably disposed near the sides of the architectural detail 100 to increase the stability of the architectural detail 100 when resting upon a support surface 112, such as a drying rack. The support members 122 are coupled to a substantially planar mounting surface 120 of the core 118, the substantially planar mounting surface 120 adapted to be mounted flush against a building structure 124. Each support member 122 may extend the entire longitudinal length of the architectural detail 100 or may be intermittently disposed along the longitudinal length of the architectural detail 100. The support members 122 preferably are oriented so as to be parallel to one another.

Preferably, the support members 122 are integrally formed with the core 18. In one embodiment, the core 118 and the support members 122 are simultaneously extruded from a well known extruder (not shown for clarity) so as to be integrally formed with one another, such that the core 118 and the support members 122 are a unitary, homogenous structure. Although the illustrated embodiment depicts the support members 122 as integrally formed with the core 118, it should be apparent to those skilled in the art that the support members 122 may be separate elements removably coupled to the core 118. Further still, although the illustrated embodiment depicts two support members 122 for supporting the architectural detail 100 upon a support surface 112, it should be apparent to those skilled in the art that other numbers of support members 122 are suitable for use with the present invention, such as one, or a number greater than two. Further yet, although a specific geometric shape of the support members 122 are illustrated and described, it should be apparent to those skilled in the art that the support members 122 may take many suitable forms and/or geometric shapes, such as rectangular shapes, oval shapes, arcuate shapes or hybrid linear and arcuate shapes.

The architectural detail 100 also differs from the above described architectural detail of FIG. 1 in the coverage of the covering 114. The covering 114 in FIGS. 2 and 3 extends slightly upon the mounting surface 120 at the edges of the mounting surface 120 to form strips of covering overlays 116. Inasmuch as the covering overlays 116 only slightly extend or overlie the mounting surface 120, the mounting surface 120 is still kept substantially free of the covering 114. However, by extending the covering 114 around the bottom outer edges of the core 118, the core is kept hidden when mounted upon a building surface 124. Preferably, the covering overlays 116 are thin in depth such that the mounting surface 120 engages or is kept as close as possibly to the building surface 124 when installed.

The installation of the architectural detail 100 is substantially similar to the method of installation of the above described embodiment with exception of the manner of removal of the support members 122. In the embodiment of FIGS. 2 and 3, the support members 122 are abraded off to convert the architectural detail 100 from the form shown in FIG. 2 to the form shown in FIG. 3, which is ready to be installed upon a structure 124 to enhance the appearance of the structure. A few suitable examples of abrasion removal techniques which may be employed to remove the support members 122 are through the use of a rasp, grinder, sand paper, power sander, and/or by rubbing the support members against a rough surface, such as a textured and/or stucco wall surface.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An architectural detail for coupling to a structure to enhance the appearance of the structure, the architectural detail comprising:

(a) a core defining a geometry having an exterior, the exterior having a planar mounting surface having first and second edges and an appearance surface extending between and intersecting the first and second edges;

(b) an outer covering adhered to the appearance surface, the first and second edges, and a portion of the planar mounting surface adjacent the first and second edges; and (c) a support member extending outward from the planar mounting surface, the support member positioned between the edges and spaced inwardly from the edges, wherein the support member and the core are integrally formed from the same material such that the support member and the core are a unitary, homogeneous structure, the support member sized and configured to position the planar mounting surface of the architectural detail a selected distance above a support surface such that the outer covering does not touch the support surface.

2. The architectural detail of claim 1, wherein the support member is removable from the core.

3. The architectural detail of claim 2, wherein the support member includes an area of reduced strength adapted to permit the support member to be selectively removed from the architectural detail by breaking the support member along the area of reduced strength.

4. The architectural detail of claim 1, wherein the support member extends substantially the entire length of the architectural detail.

5. The architectural detail of claim 1, further including an additional support member extending outward from the core, the additional support member adapted to aid the support member in supporting the architectural detail the selected distance above the support surface such that the outer covering disposed on the core of the architectural detail does not touch the support surface, said additional support member being spaced from said edges and the other support member.

6. The architectural detail of claim 5, wherein the support member and the additional support member are oriented substantially parallel to one another and extend along substantially the entire length of the architectural detail.

7. The architectural detail of claim 1, wherein the support member includes an enlarged base portion coupled to the core by a reduced connector portion, wherein the enlarged base portion may be moved to cause the reduced connector portion to break, freeing the support member from the core.

8. The architectural detail of claim 1, wherein the support member is sized and configured to position the planar mounting surface in a spaced, substantially parallel relationship relative to a support surface such that the outer covering disposed on the core of the architectural detail does not touch the support surface.

9. The architectural detail of claim 1, wherein the support member is removable from the core through abrasion.

* * * * *